United States Patent [19]

Knechtel et al.

[11] 4,212,264

[45] Jul. 15, 1980

[54] APPARATUS FOR SUPPLYING ELECTROPHOTOGRAPHIC DEVELOPER

[75] Inventors: Wilhelm Knechtel, Biebertal; Taisuke Tokiwa, Fernwald, both of Fed. Rep. of Germany

[73] Assignee: Canon Kabushiki Kaisha, Tokyo, Japan

[21] Appl. No.: 902,905

[22] Filed: May 5, 1978

[30] Foreign Application Priority Data

May 26, 1977 [DE] Fed. Rep. of Germany ..... 2723805

[51] Int. Cl.[2] ..... G03G 15/08

[52] U.S. Cl. ..... 118/653; 118/657; 118/655; 222/DIG. 1; 222/161; 222/367; 222/412

[58] Field of Search ..... 118/653, 654, 655, 656, 118/657, 658; 222/DIG. 1, 161, 167, 196, 367, 412, 413

[56] References Cited

U.S. PATENT DOCUMENTS

| | | | |
|---|---|---|---|
| 143,323 | 9/1873 | Bradford | 222/413 X |
| 1,214,776 | 2/1917 | Greenfield | 222/367 X |
| 3,258,174 | 6/1966 | Mullen | 222/367 X |
| 3,319,825 | 5/1967 | Dore | 222/413 X |
| 3,526,341 | 9/1970 | Johnston | 222/167 |
| 3,581,949 | 6/1977 | Conrad et al. | 222/167 |
| 3,622,054 | 11/1971 | Davidson | 222/DIG. 1 X |
| 3,915,340 | 10/1975 | Koeleman | 222/167 X |
| 3,979,026 | 9/1976 | Lee | 222/167 |
| 4,080,054 | 3/1978 | Watanabe | 222/DIG. 1 X |

*Primary Examiner*—Roland E. Martin, Jr.
*Attorney, Agent, or Firm*—Fitzpatrick, Cella, Harper & Scinto

[57] ABSTRACT

Apparatus for supplying electrophotographic developer to an electrophotographic developing device is disclosed. The developer supply apparatus includes a cartridge containing therein an amount of developer and supported within the housing of the supply apparatus in a manner that the cartridge is allowed to move rotationally and reciprocally around and along its axis. The cartridge has an opening at its one end and also a plural number of ribs provided within the cartridge. During the movement of the cartridge, the ribs stir the developer contained in the cartridge and also cause the developer to move toward the opening. The cartridge is brought into motion responding to a supply signal so as to effect a supply of developer from the cartridge to the developing device.

19 Claims, 9 Drawing Figures

APPARATUS FOR SUPPLYING ELECTROPHOTOGRAPHIC DEVELOPER

BACKGROUND OF THE INVENTION

1. Field of the Invention

The present invention relates to apparatus for supplying developer for use in electrophotography as well as a developing apparatus provided with the developer supply apparatus.

2. Description of the Prior Art

For electrophotographic developing apparatus there are used, as electrophotographic developing agent, dry colored particles which are generally called toner. Regarding such dry toner, it is well known that a difficulty arises in supplying the toner from a toner reservoir to a container for development due to its poor fluidity.

For this reason, the procedure of supplying toner hitherto conventionally employed was very troublesome. The operator visually observes the copy sheet having thereon a toner image after developing and when the density of the toner image is low and the operator judges the copy to be too thin, he opens the package of a container containing a large volume of toner. Then the operator pours a suitable amount of toner into the toner container for development.

Also, such toner supplying means is known that is adapted for automatically effecting a supply of toner. In this case, the supply of toner is carried out portionwise in an optimum amount according as the number of copies then made.

However, toner particles are very fine particles and therefore toner is poor in fluidity so that it is apt to bridging within the toner reservoir. Therefore, it is a difficult task to supply such toner to a developing container with sufficient accuracy. In particular, when toner becomes sticky because of heat and/or humidity, the fluidity of toner is reduced to a great extent.

To avoid the problems involved in use of toner, for the conventional apparatus there is provided in the toner reservoir a separate stirring device (cf. U.S. Pat. No. 3,196,831 specification, in particular FIG. 7 thereof) or other similar additional means, for example, spiral toner conveying means. However, such additional means, whether it may be toner stirring means or spiral toner conveying means, gives rise to another problem. Namely, such means forms a cavity of toner within the toner reservoir and makes the remainder of toner around the cavity stick onto the inner wall surface of the reservoir which is well known as the so-called bridging phenomenon. When such bridging once occurs, it often blocks further transportation or flow of toner.

With any of the above described means of the prior art, it is impossible to allocate just an optimum amount of toner to one supply, when a supply of toner becomes necessary, responding to the result of measurement, for example, of toner density and then to correctly effect supplying the allocated toner to the reservoir.

A solution to the problem of bridging is disclosed in U.S. Pat. No. 3,606,864 (refer to FIGS. 1 through 3 and the relevant description). According to the solution, the toner reservoir is formed to have a dural structure opposed to the developer applicator. More particularly, the reservoir comprises a stationary cylindrical housing and a rotatable hollow cylinder disposed within the housing. The two cylinders each have one slot extending along the length of each cylinder passing through the wall. Toner is contained in the inner rotatable cylinder and the latter thus charged with toner is driven to rotate. When the two slots coincide with each other in position, the toner contained in the inner cylinder is allowed to be discharged from the inner cylinder to the outside of the outer cylindrical housing through the slots.

This known toner supply device has various drawbacks. Firstly, sealing of the rotary part of the device is very troublesome. Secondly, when the toner contained in the cylinder is completely consumed and the supply device is emptied, exchanging of the empty container for new one or recharging the empty container with toner is not easy to carry out. Finally, it is complicated in structure.

SUMMARY OF THE INVENTION

Accordingly, it is an object of the present invention to provide apparatus for supplying developer which eliminates the above mentioned disadvantages and drawbacks involved in the conventional supply apparatus and which enables the prevention of the bridging phenomenon.

It is another object of the invention to provide such developer supply apparatus which can prevent the apparatus from being contaminated by developer and also enables the discharge of developer in an optimum amount every time while preventing bridging.

It is another object of the invention to provide an improved developer supplying apparatus which is able to interlock with measuring and control means for supply of developer and with which a constant amount of developer can be supplied.

It is another object of the invention to provide such developer supply apparatus which comprises a cartridge charged with developer and with which a supply of developer in an optimum amount can be effected by a motion of the cartridge itself.

A still more specific object of the invention is to provide apparatus for supplying developer which comprises a developer containing cartridge having an opening at its one end and supported for turning motions of the cartridge around and along its axis and ribs provided within the cartridge so that a predetermined amount of developer may be supplied through the opening every rotational motion of the cartridge.

A further object of the invention is to provide such developer supply apparatus which comprises a developer containing cartridge in the form of cylinder and in which the cartridge is supported to turn about its axis, which is inclined relative to a horizontal line.

Still a further object of the invention is to provide such developer supply apparatus which comprises spiral ribs provided in the cartridge.

Another specific object of the invention is to provide such developer supply apparatus in which the cartridge has a cap fixedly secured thereto and has an opening in the cap, which opening can be closed, and a shovel is provided in front of the opening.

It is a still more specific object of the invention to provide the above described type of supply apparatus in which the cartridge has at least one end thereof cams which slide along a curve on a cam follower so that while the cartridge is being turned, the cartridge may also be subjected to vibration.

These objects are attained by the apparatus as defined in the appended claims.

According to one aspect of the invention, a cartridge charged with developer is supported on a stationary support column for use so as to take an approximately horizontal position. The amount of developer with which the cartridge is charged is so selected that in this horizontal position of the cartridge there may exist a certain spacing between the surface of toner contained in the cartridge and the cap with which the open end of the cartridge is covered. Thus, even when the cap is removed from the cartridge, no portion of the toner can drop out from the open end of the cartridge so long as the cartridge lies still in this horizontal position.

For supplying the toner from the cartridge, the latter is operationally connected to a cartridge driving mechanism. By the connection, the cartridge is driven into a rotational or reciprocal motion around or along its longitudinal axis. Upon the time, the sloped surface of the toner within the cartridge becomes flat in the horizontal direction and the toner is discharged from the cartridge into the developer container for development through the opening of the cartridge. Thus, a supply of toner is effected.

According to another aspect of the invention, to accelerate the movement of toner toward the discharge opening during the rotational motion of the cartridge, that is, during supply, there is provided a rib or ribs serving as a guide for the flow of toner. During the rotation of the cartridge, toner particles adhered onto the inner wall surface continuously fall down toward the lower wall surface owing to the effect of gravity and centrifugal force. Since such movement of toner particles is repeated many times during the rotation of the cartridge, there is obtained a very remarkable stirring effect. Thus, within the cartridge there is produced a synergism of stirring and transporting for toner, which enables to move the toner in the cartridge toward the discharge opening while stirring the toner without any trouble of bridging.

The rib provided within the cartridge is preferably of spiral or other similar form.

According to the present invention, the cartridge itself is turned, which is contrasted with the apparatus of the prior art in which a cartridge is fixedly and stationarily mounted and a separate stirring device rotates in the cartridge. This feature of the present invention brings forth a particular effect with respect to stirring action and prevention of bridging.

Other and further objects, features and advantages of the invention will appear more fully from the following description taken in connection with the accompanying drawings.

DESCRIPTION OF THE PREFERRED EMBODIMENT

Figure 1A:
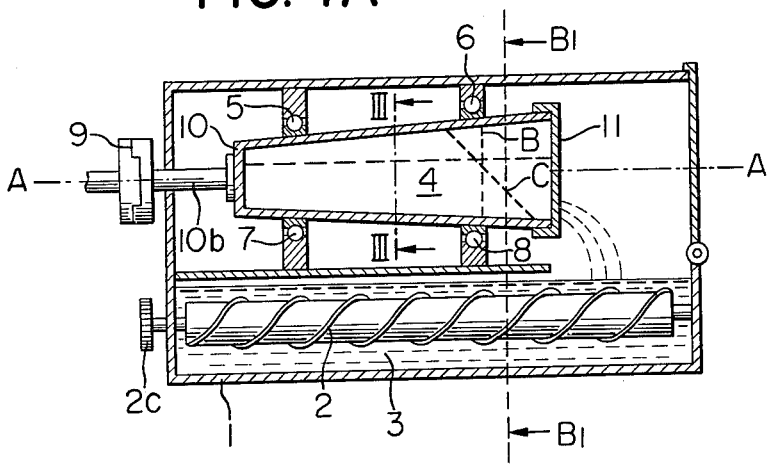
FIG. 1A is a sectional view of a developing apparatus in which the present invention is embodied.
Figure 1B:
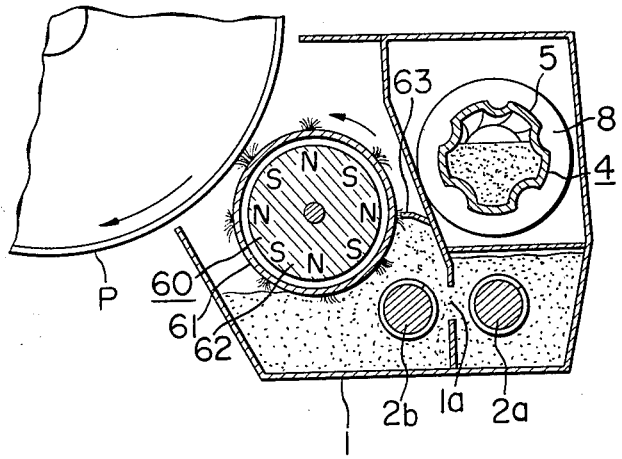
FIG. 1B is a cross section taken along the line $B_1$—$B_1$ in FIG. 1A.

Referring first to FIGS. 1A and 1B, there is shown a developing apparatus in which the present invention is embodied.

Designated by 1 is a developer container and a developer supplying apparatus according to an embodiment of the invention generally designated by 4. As best seen in FIG. 1B, the developer container 1 is divided into three compartments in which the developer supplying apparatus 4, a developer feeding screw *2a*, a developing device 60 etc. are provided. The developing device 60 is disposed opposed to a photosensitive drum P for carrying thereon an electrostatic latent image or other suitable carrier for electrostatic latent image.

The screw *2a* serves to stir toner supplied from the developer supplying apparatus 4 and to mix it with iron powder functioning as a toner carrier. For the sake of explanation, the screw *2a* is hereinafter referred to as a first screw. Opposed to the first screw *2a* there is disposed a second screw *2b*. Between the first and second screws there is interposed a wall of compartment having an opening *1a*. The direction of screw thread on the second screw is opposite to that of the first screw. The opening *1a* permits to feed the mixed developer from the first screw *2a* to the second screw *2b*.

The developing device 60 has a non-magnetic rotary cylinder 61 (hereinafter referred to also as sleeve) and a magnet 62 disposed therein. Thus, a magnetic brush is formed on the sleeve to develope the electrostatic latent image carried on the drum P and it is rotated in the direction indicated by the arrow in FIG. 1B. In order to regulate the degree of erection of bristles of the magnetic brush, a regulating member 63 is provided with its edge being spaced from the surface of the sleeve by a predetermined distance.

Under the action of magnetic field, the developer arrived at the position of the second screw *2b* is supplied onto the sleeve. On the other hand, the magnetic brush is bristled at the portions of magnetic poles as shown in FIG. 1B so as to develope the electrostatic latent image with it.

For such developing process of electrostatic latent image as described above, it is known that there occurs almost no consumption of iron powder, that is, carrier and that toner is continuously consumed during the process. Therefore, the iron powder remains in the developer container 1 essentially unchanged in its volume, but the volume of toner remained within the container 1 is gradually decreased. With the decrease of toner content in the mixed developer, the density of developed image becomes thinner and thinner accordingly. To keep the density of developed image optimum, a supply of toner is required. This supply of toner must be carried out in an optimum amount every time. For example, it must be carried out correctly in accordance of the consumption of toner within the developer container 1.

In order to realize such optimum supply of toner, the embodiment of the invention shown in FIGS. 1A and 1B comprises a toner containing cartridge 4 horizontally supported by bearings 5, 6, 7 and 8 along its length so that the cartridge is turnable, rotatable or reciprocatingly pivotable (hereinafter of the specification, called rotatable) about and along the axis A—A.

The cartridge 4 is connected with driving means (not shown) through coupling means 9 which may be any suitable known coupling means such as mechanical clutch or magnetic clutch.

The cartridge 4 diverges from its closed end toward its open end covered with a cap 11 and therefore it is in a shape of truncated cone as best seen in FIG. 1A. The volume of toner packed within the cartridge 4 is not so large enough to completely fill the cartridge with toner. The volume of toner is so determined that when the cartridge stands right before use, the level of toner may lie in the position B suggested by dotted line in FIG. 1A. When the cartridge is horizontally supported by the bearings 5 through 8 for use, the horizontal level line B of the toner takes an inclined position indicated by the inclined dotted line C. The inclination of the line C is not so acute as to allow the toner in the cartridge to contact with the cap 11. In this horizontally supported position of the cartridge, even the toner closest to the cap is backwardly spaced from the cap by a certain distance sufficient enough to prevent the toner from flowing out from the open end when the cap is removed.

Prior to mounting the cartridge 4 on the bearing 5–8, the left end portion 10 of the cartridge is connected with one end of a horizontal supporting rod **10*b* the other end of which is connected to driving means through the coupling 9 secured thereon. The driving means (not shown) is provided outside of the developer container 1**.

When the cartridge 4 is driven through the coupling 9 into a rotation about the axis A—A, the sloped toner surface line C is urged to become horizontal. Thereby, through the end opening that is now opened by removing the cap 11 the toner flows out into the developer container and more particularly onto the first screw **2*a* as suggested by broken lines in FIG. 1A. The two screws 2*a* and 2*b* (FIG. 1B) are connected to external gear (not shown) through a gear 2*c*** respectively and are always driven rotating.

The cartridge is to be selectively driven as to supply an amount of toner corresponding to the amount of toner consumed within the developer container. To produce a supply signal and initiate the necessary driving of the cartridge through the coupling 9, there may be used various known methods. For example, this may be achieved by detecting the consumption of toner in a manner known per se, delivering the detection signal to means for automatically controlling the driving means to actuate it and transmitting the driving power of the driving means to the coupling 9. Also, according to the teaching of U.S. Pat. No. 3,196,831 specification there may be provided a switch which is turned on every copying and an electro-magnetic solenoid which is intermittently energized by means of a signal coming from the switch to actuate the coupling 9. In this case, it is also possible to control the coupling means in such manner that coupling may be effected only after a given number of copies have been made. As another method, the control of toner supply may be done by detecting the density of toner optically or magnetically and selectively actuating the coupling means by means of the signal of detection thus obtained.

In this manner, the rotational and/or translational motion of the cartridge 4 is caused (rotational motion is shown in the drawing of this embodiment) in accordance of the amount of toner consumed in the developer container. The motion of the cartridge 4 causes a flow of toner in it while stirring the toner at the same time and therefore an amount of toner is supplied to the developer container. As hereinafter described in detail, a spiral rib is provided on the inner wall surface of the cartridge to accelerate the flow of toner toward the open end of the cartridge.

When all of the amount of toner contained in the cartridge are consumed by feeding out the toner and the cartridge becomes emptied, it is removed from the bearings and the like to exchange it for new one. Thus, the supply of toner can be continued smoothly again.

Figure 2:
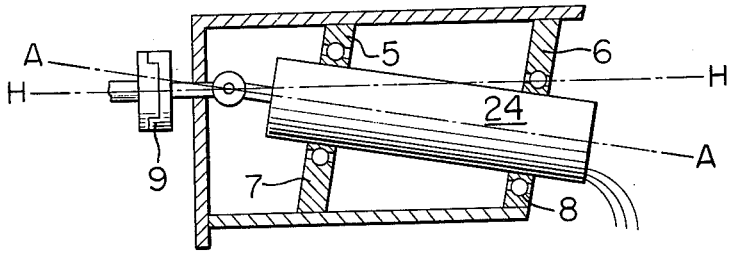
FIG. 2 shows a second embodiment of developer supply apparatus according to the invention.

FIG. 2 shows the second embodiment of the invention in which the same reference character as used in the first embodiment indicates a member similar to that shown in FIG. 1. In this second embodiment, the cartridge 24 is designed to have a cylindrical shape. The cartridge 24 is mounted by means of a universal joint rotatably about the axis A—A inclined relative to the horizontal axis H—H. Owing to the inclined mounting of the cartridge, the toner contained in the cartridge is discharged from the opening of the cartridge, falling down into the developer container during the cartridge being rotated.

Figure 3:
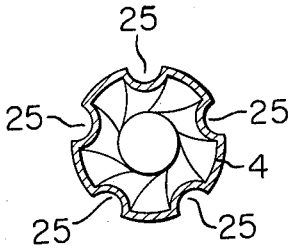
FIG. 3 is a cross section taken along the line III—III in FIG. 1A.

FIG. 3 is a cross section of the cartridge shown in FIG. 1. As clearly seen from the section of the cartridge, spiral slots 25 are provided on the inner wall of the cartridge to accelerate the movement of toner toward the discharge opening. These slots 25, viewed from the inner surface of the cartridge, form a continuous spiral rib for stirring and forwarding toner. During the cartridge being rotated and reciprocated, the spiral rib serves to positively move the toner toward the discharge opening and also to effectively prevent toner particles from sticking in a manner of bridging.

Figure 4:
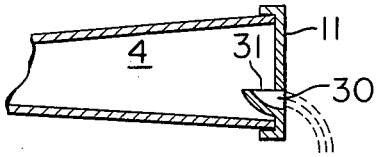
FIG. 4 shows a first modification of the developer supply apparatus shown in FIG. 1A.

FIG. 4 illustrates a modification of the first embodiment of FIG. 1. In this modification, the cap 11 is unremovably fixed onto the open end of the cartridge 4 which is different from the case of the first embodiment where the open end of the cartridge 4 is covered with a removable cap 11. The fixed cap 11 of FIG. 4 modification has an opening 30 provided in a portion of the cap. Furthermore, a shovel 31 is formed in front of the opening 30 but within the cartridge. The toner contained in the cartridge 4 is discharged from the cartridge through the opening 30 with the aid of the shovel 31 every rotation of the cartridge.

Figure 5:
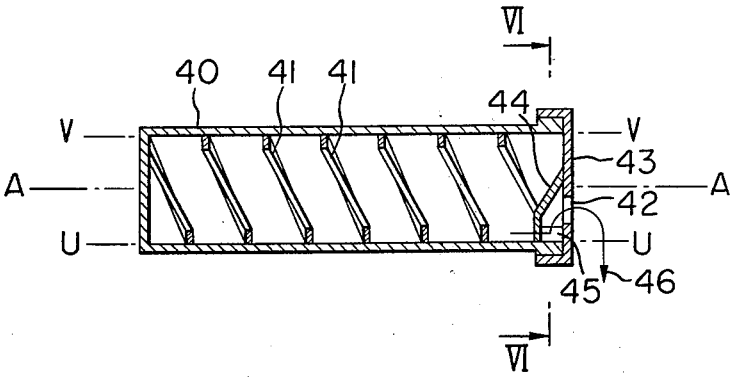
FIG. 5 shows a third embodiment of developer supply apparatus according to the invention.

FIG. 5 shows another embodiment of the present invention. In this embodiment, the cartridge 40 is also in a form of cylinder and rotatable about the axis A—A through a coupling not shown but similar to that shown in FIG. 1A. Within the hollow cylindrical cartridge 40 and extending along its inner wall, there is provided a spiral 41 adapted for stirring and transportation of toner contained in the cartridge.

When rotational and reciprocal motion of the cartridge is caused, the toner in the cartridge, for example, present on the bottom line U—U is displaced to the position of line V—V. During this movement of the toner, the latter is subjected to the action of the spiral 41 and urged to move to the right as viewed in the drawing of FIG. 5. Thus, the toner is discharged from the cartridge through exit opening hereinafter described. The right side end of the cartridge is closed with a cap 43 having a small opening 42 provided in the lower portion thereof. At the position immediately above the opening 42, the cap 43 is branched so as to form a shovel 44. The shovel depending from the cap is curved toward the inner part of the cartridge in such a manner as to cover the small opening 42. As clearly shown in FIG. 6, there is provided an opening 45 in the shovel 44. Toner passes through the opening 45 at first and then it is discharged from the cartridge through the small opening 42 provided in the cap 43. The flow of toner discharged through the small opening 42 is suggested by the arrow 46 in FIG. 5.

Figure 6:
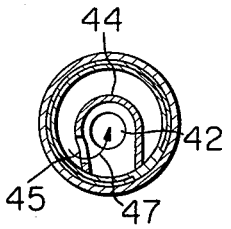
FIG. 6 is a cross section taken along the line VI—VI in FIG. 5.

According to the embodiment of FIGS. 5 and 6, an optimum amount of toner is scooped portionwise from the toner contained in the cartridge by the shovel 44 in accordance of the size of the opening 45 provided therein and the optimum amount of toner thus divided is supplied to the developer container every time.

Figure 7:
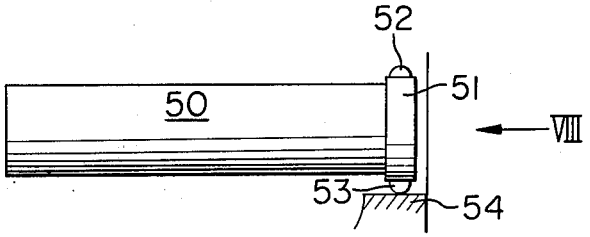
FIG. 7 is a fourth embodiment of developer supply apparatus according to the invention.

FIG. 7 shows still a further embodiment of the invention. In FIG. 7, the cartridge 50 is shown as a cylindrical cartridge. However, the cylindrical shape of the cartridge is not essential for this embodiment. It may be of another shape such as truncated cone. The open end of the cartridge 50 is covered with a cap 51 on which two cams 52 and 53 are provided. As clearly shown in FIG. 8, the cartridge 50 is received by a bearing 54 in which there is provided a cam follower 55 for the cams 52 and 53. The cam follower 55 comprises a curve along which the cams slide. The curve is so designed that every half rotation of the cartridge 50, the latter may be raised up and when it reaches the end 56 of the curve, the cartridge falls down on the surface of the bearing 54. In this manner, when the cartridge 50 is driven, it experiences not only a rotational movement but also an up-and-down movement (vibration), which contributes to a thorough stirring of toner within the cartridge. As a result, sticking of toner particles onto the inner wall surface of the cartridge and therefore the phenomenon of bridging are completely prevented. A spring 57 enhances the up-and-down motion of the cartridge. Instead of the spring, other known means suitable for this purpose such as electromagnetic means may be employed.

Figure 8:
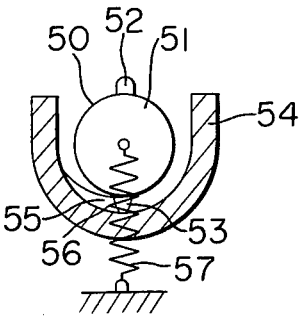
FIG. 8 is a side view of the fourth embodiment viewed in the direction of arrow VIII.

In the embodiment shown in FIGS. 7 and 8, vibrating means comprising a pair of cams and a cam follower is provided only at the right-hand end of the cartridge 50 as viewed in the drawing. But, the provision of such vibrating means is never limited only for the one end of the cartridge. Another set of such vibrating means may be provided also for the other end of the cartridge. In this case, it is recommendable that the cartridge be operationally connected with driving means through a universal joint or the like.

While the invention has been particularly shown and described with reference to preferred embodiment thereof, it will be understood by those skilled in the art that the foregoing and other changes in forms and details can be made without departing from the spirit and scope of the invention.

What we claim is:

1. Electrophotographic developing apparatus comprising:

means for applying developer onto a surface to be developed;

means provided in a vicinity of said applying means for conveying developer to said applying means; and means for supplying developer to said developer conveying means, said supplying means including a housing, a developer cartridge having an opening at one end and rotatably supported in said housing about its substantially horizontally oriented longitudinal axis, means for rotating said cartridge, and means for vibrating said cartridge in a direction different from the rotational direction of said cartridge, said vibrating means comprising a cam and a follower, both of which are provided at an end of said cartridge.

2. Apparatus as claimed in claim 1, wherein guide member is provided within a said cartridge for making the contained developer move toward said opening of the cartridge in cooperation with the motion of the driven cartridge.

3. Apparatus as claimed in claim 1, wherein said developing apparatus includes means for detachably mounting said cartridge to said apparatus.

4. Apparatus for supplying electrophotographic developer, said apparatus comprising in combination:

(a) a housing;

(b) a developer cartridge rotatably supported in said housing about its substantially horizontally oriented longitudinal axis, said cartridge having an opening at one end;

(c) means for rotating said cartridge; and (d) means for vibrating said cartridge in a direction different from the rotational direction of said cartridge, said vibrating means comprising a cam and a follower, both of which are provided at an end of said cartridge.

5. Apparatus as claimed in claim 4, wherein said opening is formed by a removable cap.

6. Apparatus as claimed in claim 4, wherein said cartridge is so shaped as to diverge toward said opening.

7. Apparatus as claimed in claim 4, wherein said cartridge is in a form of a cylinder and is supported rotatably around its axis which is inclined relative to the horizontal direction.

8. Apparatus as claimed in claim 4, wherein said cartridge has a plural number of ribs provided therein.

9. Apparatus as claimed in claim 8, wherein said ribs are spiral.

10. Apparatus as claimed in claim 4, wherein said cartridge has a cap fixedly secured thereto, said cap having an opening for supplying developer.

11. Apparatus as claimed in claim 10, wherein a shovel is provided within the cartridge in front of said opening.

12. Apparatus as claimed in claim 4, wherein said vibrating means acts on said cartridge to cause vertical movement during rotation thereof.

13. Apparatus as claimed in claim 4, wherein said vibrating means applies an impact or other similar intermittent force to said cartridge during rotation thereof.

14. Apparatus as claimed in claim 4, wherein said vibrating means causes said cartridge to spring in a bearing for supporting said cartridge.

15. Apparatus as claimed in claim 4, wherein the developer is a toner and wherein a driving mechanism for causing the rotation of said cartridge is actuated in accordance with the amount of toner consumed within the developer container to which the toner is supplied from said cartridge.

16. Apparatus as claimed in claim 4, wherein said cartridge is in the shape of a truncated cone.

17. Apparatus as claimed in claim 4, wherein said cam follower is provided on a bearing for supporting said cartridge, and wherein said cam and follower cause an intermittent lifting-up and falling-down of the cartridge.

18. Apparatus as claimed in claim 17, wherein said falling movement of cartridge is enhanced by means of a spring.

19. Apparatus as claimed in claim 17, wherein said falling movement of cartridge is electromagnetically enhanced.

* * * * *